US006704534B2

(12) United States Patent
Hibino

(10) Patent No.: US 6,704,534 B2
(45) Date of Patent: Mar. 9, 2004

(54) DEVELOPING DEVICE HAVING MINIMUM MAGNETIC FIELD STRENGTH ADJACENT REGULATING MEMBER

(75) Inventor: Masaru Hibino, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 09/939,776

(22) Filed: Aug. 28, 2001

(65) Prior Publication Data

US 2002/0028091 A1 Mar. 7, 2002

(30) Foreign Application Priority Data

Aug. 29, 2000 (JP) ..... 2000/259880

(51) Int. Cl.[7] ..... G03G 15/09

(52) U.S. Cl. ..... 399/277; 399/275

(58) Field of Search ..... 399/267, 274, 399/277, 273, 272, 275

(56) References Cited

U.S. PATENT DOCUMENTS

| | | | | | |
|---|---|---|---|---|---|
| 4,492,456 | A | * | 1/1985 | Haneda et al. | 399/275 |
| 4,825,241 | A | * | 4/1989 | Saijo et al. | 399/275 |
| 4,959,692 | A | * | 9/1990 | Hayashi et al. | 399/234 |
| 5,044,313 | A | * | 9/1991 | Yuge et al. | 399/103 |
| 5,446,526 | A | * | 8/1995 | Shimizu | 399/274 |
| 5,991,585 | A | * | 11/1999 | Nakamura | 399/267 |
| 6,067,433 | A | | 5/2000 | Kimura et al. | 399/274 |
| 6,078,768 | A | * | 6/2000 | Suzuki | 399/252 |
| 6,112,042 | A | * | 8/2000 | Imamura et al. | 148/103 |
| 6,421,520 | B2 | * | 7/2002 | Masuda et al. | 399/277 |

FOREIGN PATENT DOCUMENTS

JP 09211989 A * 8/1997 ..... G03G/15/09

OTHER PUBLICATIONS

U.S. patent application Ser. No. 09/536,306, filed Mar. 27, 2000, allowed.
U.S. patent application Ser. No. 09/717,336, filed Nov. 22, 2000, pending.
U.S. patent application Ser. No. 09/359,733, filed Jul. 23, 1999, pending.

* cited by examiner

*Primary Examiner*—Robert Beatty
(74) *Attorney, Agent, or Firm*—Fitzpatrick, Cella, Harper & Scinto

(57) ABSTRACT

A developing device includes a developing container for containing therein a developer provided with a carrier and a toner, a conveying device for conveying the developer in the developing container, a developer bearing member for bearing thereon the developer conveyed by the conveying device, the developer bearing member conveying the developer to a developing portion for developing a latent image formed on an image bearing member, a magnetic field generating device provided in the developer bearing member for generating a magnetic field, the magnetic field generating device being provided with a first magnetic pole and a second magnetic pole provided so as to be adjacent to the downstream side of the first magnetic pole in the direction of rotation of the developer bearing member and having the same polarity as the first magnetic pole, and a regulating device for regulating the layer thickness of the developer on the developer bearing member at a location substantially opposed to the second magnetic pole. The component Br of the intensity of the magnetic field formed between the first magnetic pole and the second magnetic pole in a direction perpendicular to the surface of the developer bearing member assumes a minimum value at a location nearer to the second magnetic pole than to the first magnetic pole, and the minimum value is of the same polarity as the first magnetic pole.

12 Claims, 3 Drawing Sheets

DEVELOPING DEVICE HAVING MINIMUM MAGNETIC FIELD STRENGTH ADJACENT REGULATING MEMBER

BACKGROUND OF THE INVENTION

1. Field of the Invention

This invention relates to a developing device for use in an image forming apparatus such as a copier, a printer or a facsimile apparatus.

2. Description of the Related Art

There is a well known method of bearing a dry developer on the surface of a developer bearing member, conveying and supplying the developer to the vicinity of the surface of an image bearing member on which an electrostatic latent image is formed, developing the electrostatic latent image with the developer while applying an alternating electric field between the developer bearing member and the image bearing member, and visualizing the electrostatic latent image.

Generally, a development sleeve is often used as the developer bearing member and therefore, the developer bearing member will hereinafter be referred to as the "development sleeve", and a photosensitive drum is often used as the image bearing member and therefore, the image bearing member will hereinafter be referred to as the "photosensitive drum".

The above-described developing method is classified roughly into four kinds of development, i.e., monocomponent noncontact development in which for a nonmagnetic toner, the development sleeve is coated with the toner by a blade or the like and for a magnetic toner, the development sleeve is coated with the toner by a magnetic force, the toner is carried to the photosensitive drum by the rotation of the development sleeve, and the electrostatic latent image on the photosensitive drum is developed with the toner being in noncontact with the photosensitive drum; monocomponent contact development in which the electrostatic latent image is developed with the toner being in contact with the photosensitive drum; two-component noncontact development in which for a developer consisting of a magnetic carrier mixed with a nonmagnetic toner is borne on the development sleeve by a magnetic force, the developer is carried to the photosensitive drum by the rotation of the development sleeve, and the electrostatic latent image is developed with the developer being in noncontact with the photosensitive drum; and two-component contact development in which the electrostatic latent image is developed with the developer being in contact with the photosensitive drum. From the two viewpoints of higher quality and higher stabilization of the image, two-component contact development is often used.

A toner image formed on the photosensitive drum by the development of the electrostatic latent image is transferred onto a transferring material such as paper, whereafter it is fixed by heat, pressure, etc., whereby a final copy image is obtained. On the other hand, the photosensitive drum after the transfer of the toner image has an adhering contaminant such as any untransferred toner residual on its surface removed by a cleaner, and thereafter is repeatedly used for image formation.

In recent years, in image forming apparatuses using a two-component developing device, development for still a higher quality of image, a longer life (higher stabilization) and downsizing has been put forward. To achieve the longer life of the developing device, it is important to present the deterioration of the toner and carrier due to the compression of the developer to thereby lengthen the life of the developer.

The place in the container (developing container) of the developing device where the developer is compressed is a developer layer thickness regulating portion, and in the construction of an ordinary developing device, the developer layer thickness regulating pole of a magnet in the development sleeve is located upstream of a developer layer thickness regulating blade with respect to the direction of rotation of the development sleeve, and in this area, the developer attracted to the layer thickness regulating pole is compressed between the development sleeve and the developing container.

To weaken the compression of the developer, it is effective to weaken the force with which the developer layer thickness regulating pole attracts the developer to the development sleeve (magnetic attraction acting in a direction perpendicular to the surface of the development sleeve).

As a method therefore, mention may be made of making the magnetization of the magnetic carrier in the developer small (the direction in which this magnetization of the carrier is decreased is a direction advantageous to a higher quality image in that the force rubbing against the developed toner image on the photosensitive drum in a developing portion becomes weak), on building up such a magnetic pattern that it is difficult for magnetic lines of force from the developer layer thickness regulating pole to go around to adjacent magnetic poles and the magnetic lines of force go out perpendicularly as far as possible from the surface of the development sleeve.

As one of the methods using the latter magnetic pattern, there has been proposed a developing method using one of the repulsive magnetic poles of the magnet in the development sleeve as the developer layer thickness regulating pole. When magnetic poles of the same polarity are adjacent to each other and form a repulsive magnetic field, the magnetic lines of force of each of those magnetic poles goes out perpendicularly to the surface of the development sleeve, and the rate of change of the magnetic flux density in the direction perpendicular to the surface of the development sleeve is small. As a result, the force attracting the developer to the development sleeve becomes small, and the compression of the developer weakens. Also, as a matter of course, the amount of developer itself collected at the developer layer thickness regulating pole becomes small and from that point as well, the compression of the developer weakens.

In such a case, if there is adopted a method of installing the developer layer thickness regulating pole and the regulating blade in the lower portion of the developing device with respect to the direction of gravity, magnetically attracting and drawing the developer onto the development sleeve, and stripping the developer after development in the portion above the layer thickness regulating pole with respect to the direction of gravity, the amount of developer itself collected in the layer thickness regulating portion can be made smaller and the compression of the developer can be made lighter in pressure, and it becomes easy to downsize the developing device by the simplification of the construction of the developing device.

Relative to the developing device in which the developer layer thickness regulating pole and regulating blade are installed in the lower portion of the developing device with respect to the direction of gravity, the exposed portion of the photosensitive drum is usually located on the upper portion of the photosensitive drum and therefore, the direction of rotation of the development sleeve and the direction of rotation of the photosensitive drum often become counter to each other.

On the other hand, for the downsizing of the developing device as a single body, it is the only method to downsize such parts as the development sleeve and a developer conveying screw constituting the developing device. Recently, regarding the downsizing of the main body of a copier, there has also been proposed a construction in which a drum cleaner is detached from the main body of the copier and cleaning simultaneous with developing is effected (a cleanerless system), but again in that case, the aim at the downsizing of the main body of the copier cannot be achieved unless each of the steps of charging, exposing, developing, transferring and fixing is made compact.

As described above, the development sleeve of the developing device is made small in diameter and one of the repulsive poles of the magnet in the development sleeve is used as the developer layer thickness regulating pole (cut pole), whereby it becomes possible to construct a developing apparatus achieving a longer life.

However, when one of the repulsive poles is used as the developer layer thickness regulating pole, uneven image density in the form of the pitch of the developer conveying screw (uneven screw pitch) has occurred to the trailing end of a black solid image.

There are two types of uneven screw pitch, i.e., one of an uneven T/D ratio and one of an uneven M/S ratio. The T/D ratio is the ratio of the weight of the toner to the total weight of the toner and carrier of the developer, i.e., the toner density of the developer. The M/S ratio is a ratio of an amount (weight) of developer on the development sleeve per unit area of the development sleeve.

A description will first be made of the occurrence of the uneven screw pitch by the first-mentioned uneven T/D ratio. When one of the repulsive poles is used as the developer layer thickness regulating pole, the developer is liable to have the characteristics that (a) the developer after development stripped by the repulsive magnetic pole is liable to move to the developer layer thickness regulating pole, but (b) the amount of developer collected at the developer layer thickness regulating pole is small and the compression of the developer is weak.

Therefore, the developer coats the development sleeve in a state in which the stripped developer (the toner is being consumed by development) and the developer newly supplied to the development sleeve by the rotation of the conveying screw do not completely mix with each other. As the result, an uneven T/D ratio in the form of screw pitch occurs to the developer on the development sleeve, and the uneven screw pitch thereby occurs to the trailing end of the developed image.

A description will now be made of the occurrence of the uneven screw pitch by the second-mentioned uneven M/S ratio. Because of the above-described characteristic (b), when the conveying screw is located near the developer magnetically attracted to the developer layer thickness regulating pole, uneven compression occurs to the developer collected at the developer layer thickness regulating pole by the rotation of the screw. As a result, in the lengthwise direction of the development sleeve, an uneven coat in the form of screw pitch, i.e., an uneven M/S ratio, is formed in the developer on the development sleeve, and uneven screw pitch attributable to the uneven M/S ratio occurs at the trailing end of the developed image.

The phenomenon of the uneven screw pitch of the image by the above-described uneven T/D ratio and uneven M/S ratio becomes more liable to occur when the diameter of the development sleeve is small, in addition to the use of one of the repulsive magnetic poles as the developer layer thickness regulating pole. This is because when the diameter of the development sleeve is small, the magnetic force becomes small and the distance from the stripping pole which is the other of the repulsive magnetic poles as the developer layer thickness regulating pole becomes short and therefore the developer after development becomes liable to move from the stripping pole to the developer layer thickness regulating pole.

Such uneven screw pitch is also liable to occur when the magnetization of the carrier is made small to lengthen the life of the developer. This is because when the magnetization of the carrier is small, the developer becomes dull to a magnetic field and the developer after development is not stripped by the stripping pole, but becomes liable to move to the developer layer thickness regulating pole.

SUMMARY OF THE INVENTION

It is an object of the present invention to provide a developing device which can obtain good images free of uneven density.

Further objects of the present invention will become apparent from the following detailed description when read with reference to the accompanying drawings.

DESCRIPTION OF THE PREFERRED EMBODIMENTS

An image forming apparatus according to the present invention will hereinafter be described in detail with reference to the drawings.

Embodiment 1

Figure 1:
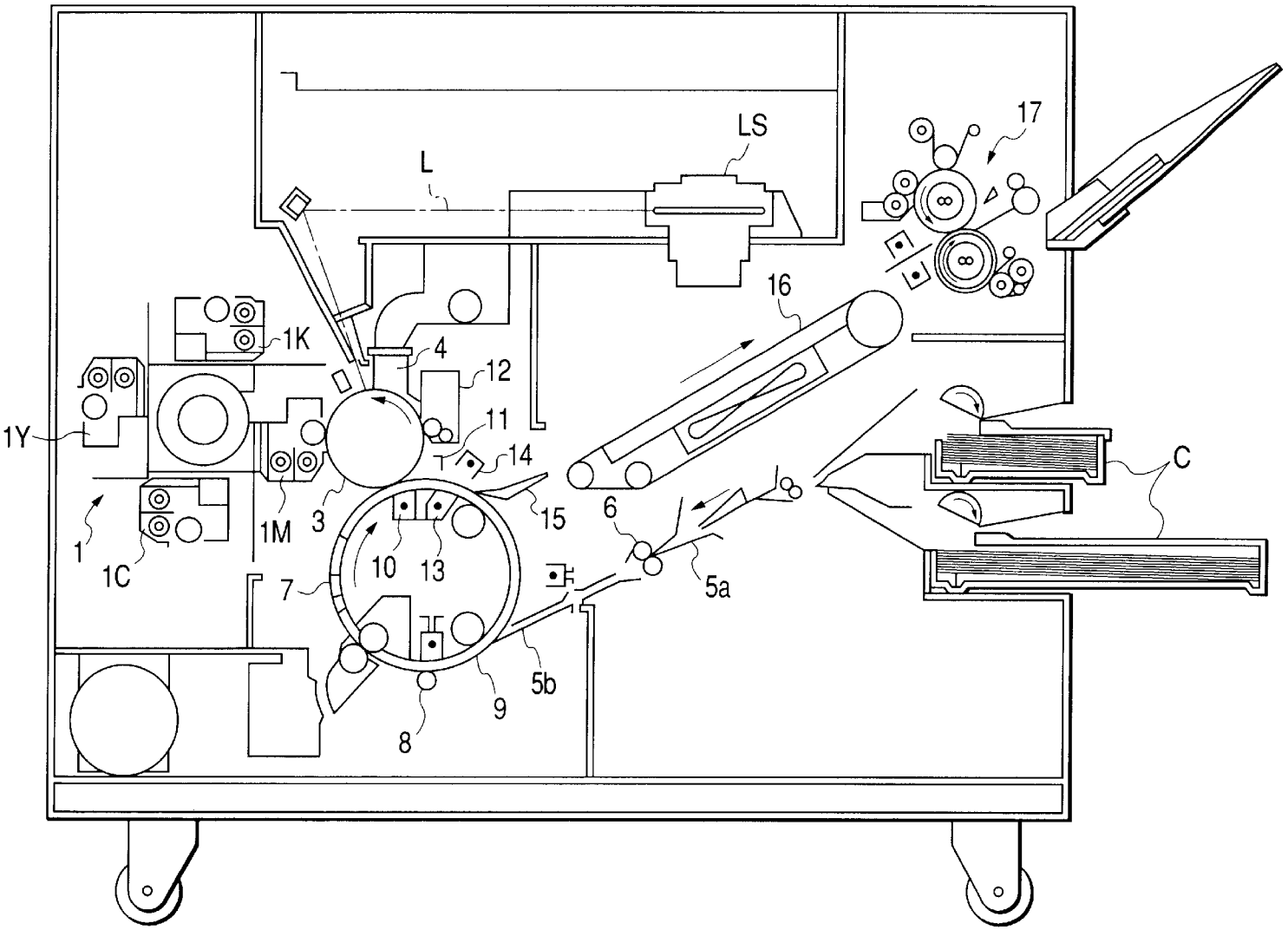
FIG. 1 is a cross-sectional view showing an embodiment of the image forming apparatus of the present invention.

FIG. 1 is a cross-sectional view showing an embodiment of the image forming apparatus of the present invention. This image forming apparatus is constructed as a color printer of the electrophotographic type.

The printer shown in FIG. 1 has an electrophotographic photosensitive member, i.e., a photosensitive drum 3, rotatable in the direction of the arrow, shown therein, as an image bearing member, and is provided with a charger 4, a rotary developing apparatus 1, a transfer discharger 10 and cleaning means 12 around this photosensitive drum 3, and is provided with exposing means (laser beam scanner) LS above the photosensitive drum 3, and the charger 4 to the exposing means LS together constitute an image forming means.

The rotary developing apparatus 1 is provided with developing devices 1M, 1C, 1Y and 1K, each of which contains therein a two-component developer containing a toner and a magnetic carrier. The developer in the developing device 1M contains a magenta toner, the developer in the developing device 1C contains a cyan toner, the developer in the developing device 1Y contains a yellow toner, and the developer in the developing device 1K contains a black toner.

An original to be copied is read by an original reading device (not shown). This original reading device has a photoelectric conversion element such as a CCD for converting the image of the original into an electrical signal, and outputs image signals corresponding to the magenta image information, cyan image information, yellow image information and black-and-white image information of the original. The exposing means LS contains a semiconductor laser therein, and the semiconductor laser has its ON/OFF condition of light emission controlled correspondingly to these image signals, and emits a laser beam L and effects exposure.

The sequence of the entire color printer will now be described briefly with the case of a full color mode taken as an example. The printer can also print out an output signal from a computer.

First, the photosensitive drum 3 is rotated in the direction of the arrow, shown therein, and the surface thereof is uniformly charged by the charger 4. Next, scanning and exposure are effected by the laser beam L modulated by the magenta image signal, and a dot distribution latent image is formed on the photosensitive drum 3. This latent image is reversal-developed by the magenta developing device 1M disposed in advance at a developing position, and is visualized as a magenta toner image.

A transferring material such as paper is picked up from a cassette C and is transported to a transferring drum 9 via a feed guide 5*a*, feed rollers 6 and a feed guide 5*b*. The transferring material transported to the transferring drum 9 has its leading end held by the gripper 7 of the transferring drum, and is electrostatically twined around the transferring drum 9 by an abutment roller 8 and a pole opposed to the abutment roller 8.

The transferring drum 9 is rotated in the direction of the arrow, shown therein, in synchronism with the photosensitive drum 3, and the magenta toner image formed on the photosensitive drum 3 by the development by the magenta developing device 1M is transferred onto the transferring material by the transfer charger 10 in a transferring portion wherein the photosensitive drum 3 and the transferring drum 9 are opposed to each other. The transferring drum 9 intactly continues its rotation and prepares for the transfer of an image of the next color (in the present embodiment, the cyan toner image).

On the other hand, the residual charges on the photosensitive drum 3 are eliminated by a charger 11, and the photosensitive drum 3 is cleaned by the cleaning means 12 and is again charged by the charger 4, and is subjected to the exposure as previously described by the laser beam L modulated by the next cyan image signal, and a dot distribution electrostatic latent image for cyan is formed on the photosensitive drum. In the meantime, the developing apparatus 1 is rotated, and the cyan developing device 1C is disposed at the predetermined developing position and effects the reversal development of the electrostatic latent image on the photosensitive drum 3 to thereby form a cyan toner image thereon. The cyan toner image is superimposed upon the magenta toner image and transferred onto the transferring material transported by the transferring drum 9.

The steps above-described are also executed for yellow and black toner images and when the superimposition transfer of the magenta, cyan, yellow and black toner images onto the transferring material is completed, the charges of the transferring material are eliminated by the inner and outer chargers 13 and 14 of the transferring drum 9, and the transferring material is released from the grip by the gripper 7 and is separated from the transferring drum 9 by a separating claw 15. The separated transferring material is conveyed to a heat-pressure roller fixing device 17 by a conveying belt 16, and the superimposed toner images of the four colors are fixed.

A series of full color print sequences are completed in this manner and a desired full color print image is obtained.

The construction of this printer is an example and for example, the charger 11 may be not a corona charger but a charging roller, and the transfer charger 10 also can adopt one of various types including a charging roller, but basically, an image is formed by way of the steps of charging, exposing, developing, transferring and fixing.

Figure 2:
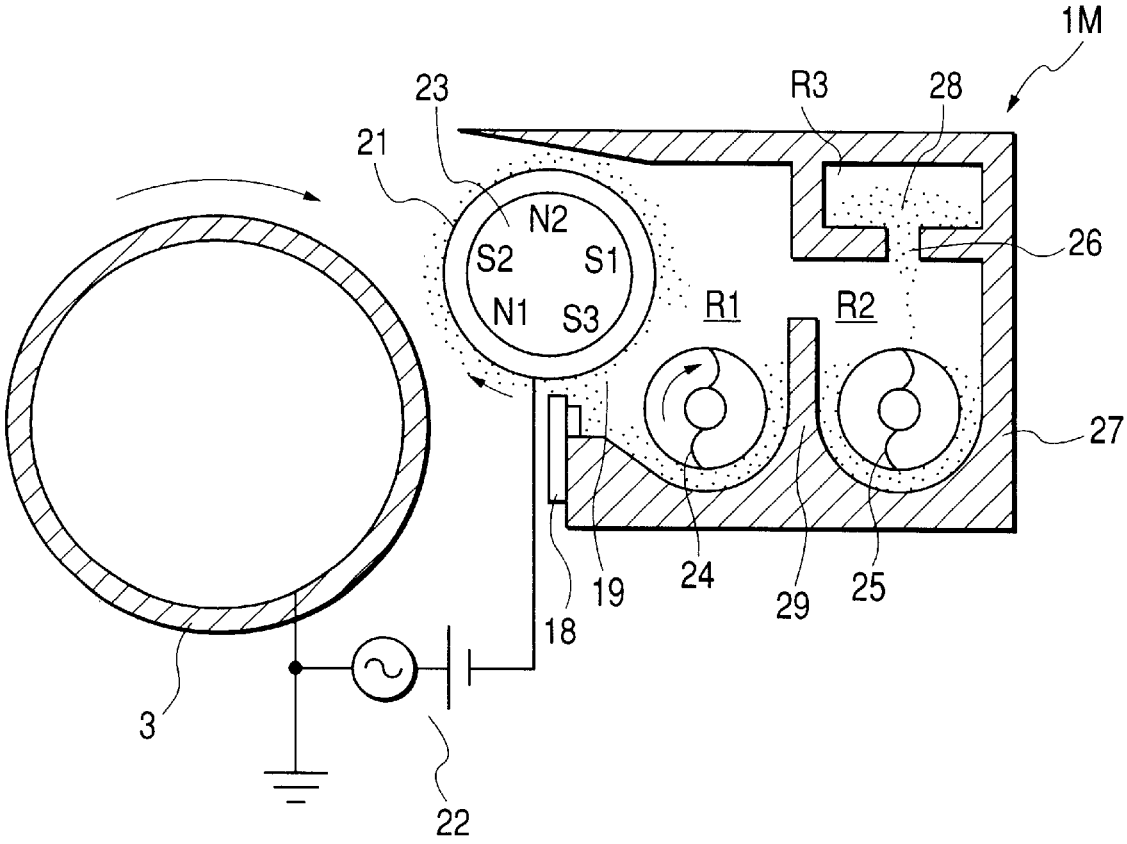
FIG. 2 is a cross-sectional view showing a developing device installed in the image forming apparats of FIG. 1.

The present invention has a great feature in the developing devices installed in the image forming apparatus. One of the developing devices 1M–1K, e.g. the magenta developing device 1M, provided in the rotary developing apparatus 1 of this printer will hereinafter be described with reference to the drawings. The developing devices 1C, 1Y and 1K are constructed basically similarly to the developing device 1M. FIG. 2 shows the construction of the developing device 1M.

The developing device 1M, as shown in FIG. 2, is provided with a developing container 27, the interior of which is compartmentalized into a developing chamber (first chamber) R1 and an agitating chamber (second chamber) R2 by a partition wall 29, and above the agitating chamber R2, a toner storing chamber R3 is provided beyond the partition wall 29, and a supply toner (nonmagnetic toner) 28 is contained in the toner storing chamber R3. The partition wall 29 is formed with a supply port 26, through which an amount of supply toner 28 corresponding to the consumed toner is downwardly supplied into the agitating chamber R2.

A developer 19 is contained in the developing chamber R1 and the agitating chamber R2. The developer 19 is a two-component developer comprising 1% by weight of titanium oxide having a mean particle diameter of 20 nm extraneously added to a nonmagnetic toner having a mean particle diameter of 8 $\mu$m manufactured by the crushing method, and a magnetic carrier having a mean particle diameter of 35 $\mu$m in which the value of magnetization at 100 mT (millitesla) is $25\times10^4$ A/m. The mixing ratio of the toner and carrier in the developer is such that the T/D ratio (the toner density of the developer) of the weight percentage of the toner to the total weight of the toner and carrier is about 8%.

The magnetization of the carrier, in the present invention, is prescribed as the magnetization per unit volume because the force acting on a carrier particle is proportional not to the mass but the volume of a carrier particle, and it is indicated at MKS unit (A/m) as described above.

An opening portion is provided in that region of the developing container 27 which is proximate to the photosensitive drum 3, and a development sleeve 21 is installed so as to protrude outwardly from this opening portion, and this development sleeve 21 is rotatably incorporated in the developing container 27. In the present embodiment, the development sleeve 21 is formed of a nonmagnetic material such as SUS 305 AC and is formed with a diameter of 16 mm. A roller-shaped magnet (magnet roller) 23 which is magnetic field generating means is fixed in the development sleeve 21. The development sleeve 21 and the photosensitive drum 3 are rotated so as to move in counter directions in the developing portion wherein they are proximate to each other.

The magnet 23 has a developing magnetic pole N1, a developer layer thickness regulating pole 53 located upstream thereof, and magnetic poles N2, S2 and S1 for conveying the developer and the magnet 23 is disposed in the development sleeve 21 so that the developing magnetic pole N1 may be opposed to the photosensitive drum 3. The developing magnetic pole N1 forms a magnetic field near the developing portion between the development sleeve 21 and the photosensitive drum 3, and by this magnetic field, a magnetic brush is formed in the developer conveyed to the developing portion with the rotation of the development sleeve 21. The developer formed into a magnetic brush contacts with the photosensitive drum 3 and develops the electrostatic latent image thereon.

During the development, a vibration bias voltage comprising a DC voltage superimposed on an AC voltage is applied as a developing bias to the development sleeve 21 by a voltage source 22. The dark section potential (nonexposed section potential) and light section potential (exposed section potential) of the latent image are located between the maximum value and minimum value of this vibration bias potential. Thereby, an alternating electric field of which the direction alternately changes is formed in the developing portion, and the toner and carrier vibrate vehemently in this alternating electric field, and the toner flies to the photosensitive drum 3 against the electrostatic binding force to the development sleeve 21 and the carrier, and an amount of toner corresponding to the latent image potential adheres to the photosensitive drum 3.

In the present embodiment, the dark section potential of the photosensitive drum 3 was −600 V and the light section potential thereof was −100 V, and as a developing bias, a vibration bias comprising a DC voltage of −400 V and an AC voltage having Vpp of 2.0 kV and a frequency Frq of 8 kHz superimposed upon each other was applied to the development sleeve 21.

The developer which has finished the development in the developing portion is returned into the developing container 27 with the rotation of the development sleeve 21, and is peeled from the development sleeve 21 by a repulsive magnetic field formed by the magnetic poles S1 and S3 of the magnet 23 and falls into and is collected in the developing chamber R1.

In the developing container 27, a developer layer thickness regulating blade 18 is fixedly installed below the development sleeve 21, and this regulating blade 18 is disposed at a predetermined interval, in the present embodiment, an interval of 350 $\mu$m, from the development sleeve 21. The regulating blade 18 is formed of a magnetic material such as iron, and cooperates with the developer layer thickness regulating pole S3 of the magnet 23 to magnetically regulate the layer thickness of the developer borne on the development sleeve 21.

A conveying screw 24 is installed in the developing chamber R1, and in the present embodiment, the conveying screw 24 has a diameter of 14 mm. The conveying screw 24 is rotated in the direction of the arrow associated therewith, and by the rotation of this conveying screw 24, the developer 19 in the developing chamber R1 is agitated and conveyed along the lengthwise direction of the development sleeve 21.

In the present embodiment, this conveying screw 24 is disposed below the development sleeve 21 with respect to the direction of gravity. Also, in order that the uneven supply (uneven drawing) of the developer to the developer layer thickness regulating pole S3 by the conveying screw 24 may become relatively small, the positional relation of the conveying screw 24 to the development sleeve 21 is set such that the most proximate position of the conveying screw 24 and the development sleeve 21 is just intermediate between the peak position of the magnetic flux density Br of the magnetic pole S1 of the magnet 23 in a direction perpendicular to the surface of the development sleeve and the peak position of the magnetic flux density Br of the magnetic pole S3 in the direction perpendicular to the surface of the development sleeve.

That is, the most proximate position of the conveying screw 24 and the development sleeve 21 is opposed to the area between the repulsive magnet poles S3 and S1 of the magnet 23 in which the magnetic flux density is small and the magnetic force is small.

The disposed position of the conveying screw 24 in a lateral direction (a lateral direction as viewed in FIG. 2) is set such that the developer stripped from the development sleeve 21 by the repulsive magnetic field falls onto the conveying screw 24 (or the area in which the conveying screw 24 is projected upwardly with respect to the direction of gravity). By adopting such a construction, the stripped developer is clockwisely agitated and conveyed by the conveying screw 24 and therefore, the stripped developer is prevented from being intactly drawn by the development sleeve 21.

It is preferable that the distance in the most proximate portion between the development sleeve 21 and the conveying screw 24 be set to 1 mm or greater and 7 mm or less with the uneven coat of the developer on the development sleeve 21 and the undesirable drawing of the developer onto the development sleeve 21, and the uneven mixing of the fresh and old developers (the developer stripped after development and the developer sufficiently agitated in the agitating chamber and the developing chamber) taken into account. It is preferable that the above-mentioned distance be set to 2 mm or greater and 5 mm or less with the above-noted points further taken into account.

A conveying screw 25 is installed in the agitating chamber R2, and the conveying screw 25 conveys the developer 19 in the agitating chamber R2 in a direction opposite to that by the conveying screw 24 along the lengthwise direction of the development sleeve 21 by the rotation thereof, and mixes a toner 28 supplied from the toner storing chamber R3 with the developer 19 in the conveying process thereof.

In the present embodiment, the conveying screw 25, like the conveying screw 24, has a diameter of 14 mm. The conveying screws 24 and 25 are equal in the pitch of the screw, i.e., the pitch being 15 mm, and are also equal in the rotating speed (the number of revolutions per unit time) and accordingly, are also equal in the developer conveying speed.

In the present embodiment, about 180 g of two-component developer is contained in the developing container 27 as described above. The T/D ratio of the developer is about 8% as previously mentioned.

The nonmagnetic toner which is one component of the developer may be one produced by the crushing method or one produced by the polymerizing method.

The volume mean particle diameter of this toner may suitably be 4 to 15 $\mu$m. The volume mean particle diameter of the toner is measured, for example, by the following measuring method.

COULTER COUNTER TA-II type (produced by COULTER K.K.) was used as a measuring apparatus, and an interface (produced by Nikkaki K.K.) for outputting a number mean distribution and a volume mean distribution and CX-i personal computer (produced by Canon, Inc.) were connected thereto. As regards electrolyte, NaCl water solution of 1% was prepared by the use of first class sodium chloride.

0.1 to 5 ml of interfacial active agent (preferably alkyl benzene sulfonate) as a dispersant is added to 100 to 150 ml of the above-mentioned electrolyte, and 0.5 to 50 mg of toner as a measurement sample is further added and mixed therewith, and the electrolyte in which the sample is suspended is dispersion-treated for about 1 to 3 minutes by an ultrasonic dispersing device, and the size distribution of toner particles of 2 to 40 $\mu$m is measured by the above-mentioned COULTER COUNTER TA-II type by the use of an aperture of 100 $\mu$m to thereby find a volume distribution, and the volume mean particle diameter of the toner is obtained from the volume distribution.

If the surface of the toner as described above is covered with an extraneous additive, two mechanical effects can be given thereto. One of the effects is that the fluidity of the toner is improved and it becomes easy for the supply toner to be agitated and mixed with the two-component developer in the developing container, and the other effect is that by the extraneous additive lying on the surface of the toner, the releasing property of the toner used for development relative to the photosensitive drum is increased and the transfer efficiency becomes good.

The extraneous additive used in the present invention may preferably have a particle diameter of 1/10 or less of the weight mean particle diameter of the toner particles, from the viewpoint of the durability when it is added to the toner. In the present invention, the particle diameter of this extraneous additive means the mean particle diameter of the toner particles found from the surface observation of the toner particles using an electron microscope.

As the extraneous additive, use is made, for example, one of metal oxides (such as aluminum oxide, titanium oxide, strontium titanate, cerium oxide, magnesium oxide, chromium oxide, tin oxide and zinc oxide), nitrides (such as silicon nitride), carbides (such as silicon carbide), metallic salts (such as calcium sulphate, barium sulphate and calcium carbonate), fatty acid metallic salts (such as zinc stearate and calcium stearate), carbon black, silica, etc.

Regarding these extraneous additives, 0.01 to 10 parts by weight, preferably 0.05 to 5 parts by weight, is used relative to 100 parts by weight of toner. These extraneous additives may be used singly or in a plurality. The extraneous additives subjected to the hydropholic treatment are more preferable.

In the present embodiment, use was made of a toner to which 1% by weight of titanium oxide having a mean particle diameter of 20 nm was extraneously added.

While in the present invention, the magnetic carrier which is the other component of the developer is a resin magnetic carrier manufactured by the polymerizing method which comprises binder resin, a magnetic metal oxide and a nonmagnetic metal oxide, it is not restricted to the carrier by this manufacturing method, but may be a ferrite carrier or the like. The weight mean particle diameter thereof is 20 to 100 $\mu$m, and preferably 20 to 70 $\mu$m.

A description will hereinafter be made of the amount of magnetization of the carrier and a method of measuring the particle diameter thereof.

First, by the use of a vibration magnetic field type automatic magnetic characteristic recording apparatus produced by Riken Denshi Co. Ltd., the magnetization ($Am^2/kg$) of a carrier packed in an external magnetic field of 100 mT was found as the magnetic characteristic of the carrier, and thereafter it was multiplied by the true specific gravity ($kg/m^3$) of the carrier to thereby calculate the amount of magnification (A/m).

The particle diameter of the carrier was calculated by photographing 300 carrier particles extracted at random by a scanning electronic microscope, and calculating the horizontal Feret diameter of the photographed image of those carrier particles as the particle diameter of the carrier by an image processing apparatus Luzex 3 produced by Nireco Corporation.

A description will now be made in detail of the positional relationships among the developer layer thickness regulating pole S3 of the magnet 23 in the development sleeve 21 used in the present embodiment, the developer stripping pole S1 cooperating therewith to form a repulsive magnetic field, and the conveying screw 24 near the development sleeve 21.

The object of the present invention, as previously described, is to obtain good images in which uneven density in the form of screw pitch is restrained in the development by the two-component developer, and also achieve the longer life of the developer and the downsizing of the apparatus.

More particularly, the present invention, when one of the repulsive magnetic poles of the magnet in the development sleeve is used as the developer layer thickness regulating pole in order to lengthen the life of the two-component developer, enables the uneven density in the form of screw pitch of the black solid portion which becomes liable to occur because of this to be eliminated and a uniform black solid image to be obtained, and enables a uniform image free of the uneven density in the form of screw pitch to be obtained even when the developer bearing member is made small in diameter in order to further achieve the downsizing of the developing device, and the magnetization of the magnetic carrier in the developer is made small in order to achieve the further lengthened life of the developer.

In the present embodiment, it is preferable that the peak value of the intensity Br of the magnetic field of the pole S3 in a direction perpendicular to the surface of the development sleeve 21 by 40 mT (millitesla) or greater and 100 mT or less, and the peak value of the intensity Br of the magnetic field of the pole S1 in the direction perpendicular to the surface of the development sleeve 21 be 40 mT or greater and 80 mT or less. In the present embodiment, the peak value of the intensity of the magnetic field of the pole S3 was 60 mT, and the peak value of the intensity of the magnetic field of the pole S1 was 50 mT.

The positional relation between the magnetic poles S3 and S1 is that the peak position of the intensity Br of the magnetic field of the stripping pole S1 in the direction perpendicular to the surface of the development sleeve is above the peak position of the intensity Br of the magnetic field of the developer layer thickness regulating pole S3 in the direction perpendicular to the surface of the development sleeve with respect to the direction of gravity. Accordingly, the position at which the regulating blade 18 is proximate to the development sleeve 21 is below the center of the development sleeve 21 with respect to the direction of gravity.

When such a positional relation is adopted, it becomes easy for the developer on the development sleeve 21 after development to fall, and even if any special stripping means is not required, it becomes easy to strip the developer, and also it becomes easy to attract the developer by the magnetic attraction by the developer layer thickness regulating pole S3 and convey it to the developing portion. That is, it is easy to simplify a mechanism for stripping the developer from the development sleeve 21, and supplying the developer to the development sleeve 21.

Also, in the present embodiment, the peak position of the intensity of the magnetic field of the pole S3 in the direction perpendicular to the development sleeve 21 and that end of the regulating blade 18 which is adjacent to the development sleeve have an angle of 5° therebetween as viewed from the central position of the development sleeve.

The pole S3 forms a repulsive magnetic field between the pole S3 and the pole S1 and therefore, the magnetic line of force of the pole S3 tends to emanate perpendicularly to the development sleeve 21. As the result, the rate of change of the magnetic field (magnetic flux density) in the direction perpendicular to the development sleeve becomes small. This means that the force attracting the developer to the development sleeve 21 becomes small. Also, the amount of developer stopped by the regulating pole S3 becomes small. Accordingly, the force with which the developer is compressed at the developer layer thickness regulating pole S3 weakens, and the deterioration of the toner and the deterioration of the developer such as the spending of the carrier are suppressed and thus, the life of the developer is lengthened.

However, when as in the present embodiment, there is adopted structure in which the development sleeve 21 is made small in diameter and the magnetic pole S3 which is one of the repulsive magnetic poles is used as the developer layer thickness regulating pole and the conveying screw 24 is disposed near the regulating pole S3, screw-shaped uneven pitch has occurred at the trailing end of a black solid image when the surface of the developer (the upper surface of the developer layer) located near the development sleeve 21 is relatively low.

As previously described, there are two types of this screw-shaped uneven pitch from the factor of occurrence, i.e., one of an uneven T/D ratio and one of an uneven M/S ratio. Describing again, as regards the first-mentioned screw-shaped uneven pitch by the uneven T/D ratio, when one of the repulsive magnetic poles, in the present embodiment, the magnetic pole S3, is used as the developer layer thickness regulating pole, there is the tendency toward the characteristics that (a) the developer after being stripped by the repulsive magnetic poles is liable to move to the regulating pole S3, and (b) the amount of developer collected at the regulating pole S3 is small and the compression thereof is weak.

Therefore, the developer coats the development sleeve in a state in which the stripped developer (the toner is being consumed by development) and the developer newly supplied to the development sleeve by the rotation of the conveying screw do not completely mix with each other. As a result, the uneven T/D ratio in the form of screw pitch occurs to the developer on the development sleeve, and the uneven screw pitch thereby occurs at the trailing end of the developed image.

Next, as regards the second-mentioned uneven screw pitch by the uneven M/S ratio, due to the above-described characteristic (b), when the conveying screw is located near the developer magnetically attracted to the developer layer thickness regulating pole, uneven compression occurs to the developer collected at the developer layer thickness regulating pole, by the rotation of the screw. As the result, an uneven coat in the form of screw pitch, i.e., the uneven M/S ratio, occurs to the developer on the development sleeve, and an uneven screw pitch attributable to the uneven M/S ratio occurs at the trailing end of the developed image.

The phenomenon of the above-described uneven screw pitch of the image by the uneven T/D ratio and the uneven M/S ratio becomes more liable to occur when as previously described, one (in the present embodiment, S3) of the repulsive magnetic poles is used as the developer layer thickness regulating pole and the diameter of the development sleeve 21 is small. It becomes still more liable to occur when the developer layer thickness regulating pole and the regulating blade 18 are located below the stripping pole (in the present embodiment, S1) with respect to the direction of gravity.

The reason for this is that when the diameter of the development sleeve 21 is small, the magnet 23 is small and the distance from the stripping pole to the developer layer thickness regulating pole is short and therefore the developer after development becomes liable to move from the stripping pole to the developer layer thickness regulating pole, and that when the developer layer thickness regulating pole is located below the stripping pole with respect to the direction of gravity, the conveying screw comes to be located near the developer compressing portion by reason of the construction thereof.

Figure 3:
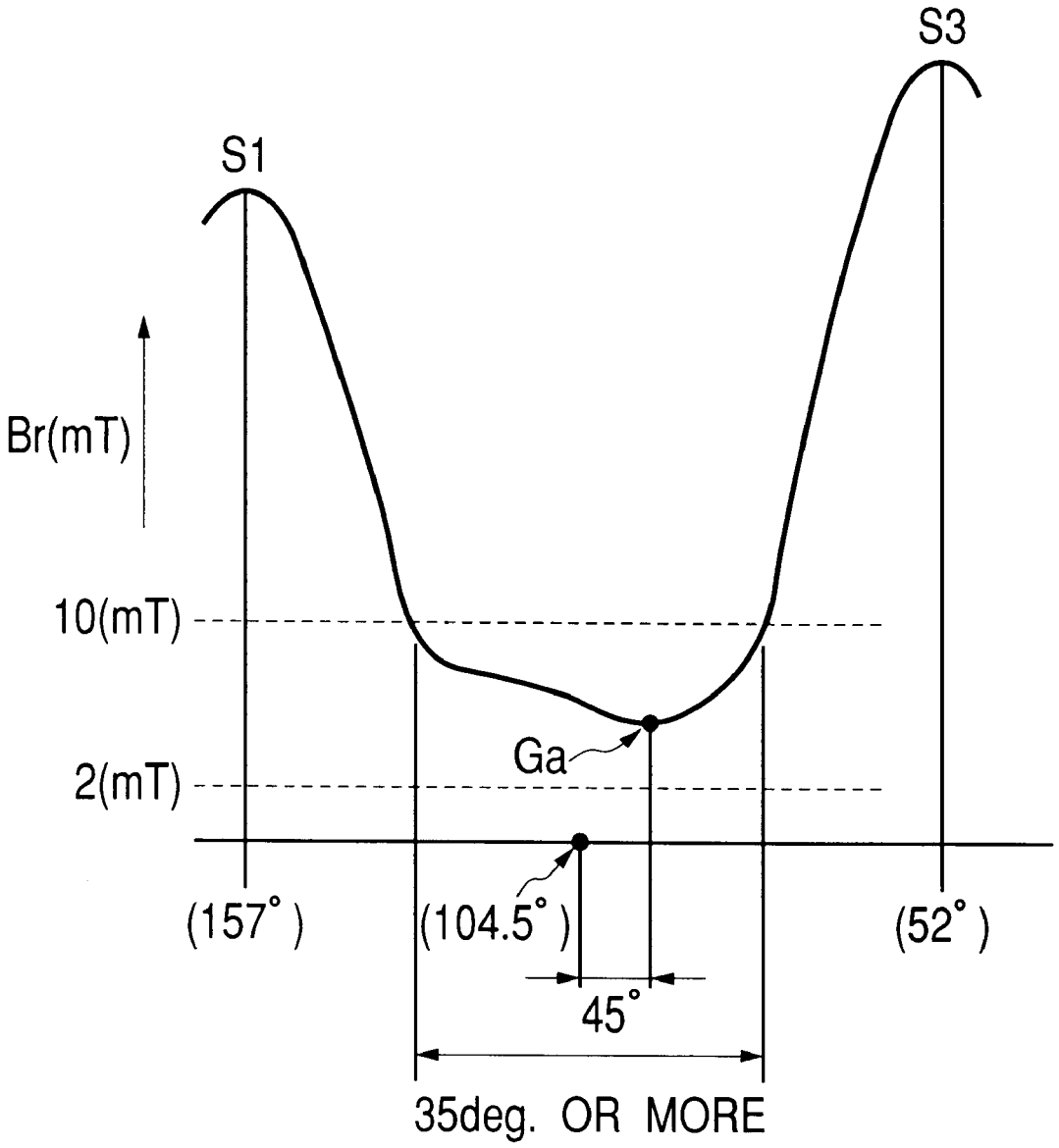
FIG. 3 is an illustration showing the distribution of the intensity of the magnetic field between two magnetic poles constituting the repulsive magnetic poles of a magnet in the development sleeve of the developing device of FIG. 2.

As the result of some studies, it has been found that uneven screw pitch (uneven density in the form of screw pitch) does not occur to the developed image by adopting the following as the distribution shape of the lower limit value of the intensity Br of the magnetic field between the developer layer thickness regulating pole S3 and the stripping pole S1 constituting the repulsive magnetic poles, in the direction perpendicular to the surface of the development sleeve 21. This will be described below with reference to FIG. 3. In FIG. 3, the axis of abscissas represent the positions in the circumferential direction of the development sleeve 21, and a position offset by 5° from the position of the main developing pole N1 in a direction opposite to the direction of rotation of the development sleeve is defined as 0°, and with this position as the reference, the angle increases in the direction opposite to the direction of rotation of the development sleeve. The axis of ordinates represents the magnitude of the intensity Br of the magnetic field.

Regarding the pattern of the intensity Br of the magnetic field between the repulsive magnetic poles S3 and S1 on the surface of the development sleeve 21 in the direction perpendicular to that surface, design is made such that as shown in FIG. 3, the area in which the lower limit value Ga is of the same polarity as the repulsive magnetic poles and the intensity Br of the magnetic field is 10 mT or less in absolute value is distributed circumferentially of the development sleeve 21 over a width of 35° (deg.) or greater (a width of ⅓ or greater of 105° corresponding to the circumferential distance between the repulsive magnetic poles, and the lower limit value Ga is 2 mT or greater and 10 mT or less, that is, satisfies $$2\ \text{mT} \leqq Ga \leqq 10\ \text{mT},$$

and the circumferential position of the lower limit value Ga on the development sleeve 21 lies on the developer layer thickness regulating pole S3 side.

The reason why the lower limit value Ga is 2 mT or greater is that when it is 2 mT or less, the magnetic flux density deflects and the opposite pole occurs and this must be avoided. Also, the reason why the lower limit value Ga is 10 mT or less is that the wider the area of 10 mT, the better, but when from the viewpoint of the manufacture of the development sleeve, the same poles are made adjacent to each other, opposite poles are liable to occur if the space between the same poles is made wide. If the opposite poles occur, the developer after development may not be stripped from the development sleeve but may go round on the development sleeve. Accordingly, the upper limit of the distribution width of the area in which the intensity Br of the magnetic field is 10 mT or less is about 180°.

In the above-described area of 10 mT or less between the repulsive magnetic poles, magnetic lines of force emanate substantially perpendicularly to the surface of the development sleeve 21 and the absolute value of the magnetic flux density is small. Accordingly, in this area, the rate of change of the density of the magnetic lines of force (magnetic flux density) in the direction perpendicular to the surface of the development sleeve can be made small. This means that the force with which the developer is attracted to the surface of the development sleeve can be made small.

By making the area in which, as described above, the intensity Br of the magnetic field between the repulsive magnetic poles S3 and S1 is 10 mT or less into 35° or greater, and providing the area in which the magnetic force hardly acts between the repulsive poles, the developer after development of which the toner has been consumed can be completely stripped from the development sleeve 21, and the uneven screw pitch attributable to the above-described T/D ratio can be suppressed.

Also, by making the area in which the intensity Br of the magnetic field between the repulsive magnetic poles S3 and S1 is 10 mT or less into 35° or greater, and further placing the position of the lower limit value Ga of the intensity Br of the magnetic field between the repulsive poles near the developer layer thickness regulating pole S3, the developer collecting portion by the regulating pole S3 can be prevented from being located near the conveying screw 24 near to the developer sleeve 21, and the uneven screw pitch attributable to the above-described uneven M/S ratio can be suppressed.

Particularly, when the diameter of the development sleeve 21 is made small, the spatial distance between the stripping pole S1 and the developer layer thickness regulating pole S3 becomes short and it becomes difficult to strip the developer having an image history after development, and the uneven screw pitch, i.e., the uneven density in the form of screw pitch, becomes liable to occur.

In a small sleeve diameter, even if the lower limit value Ga of the intensity Br of the magnetic field between the repulsive magnetic poles is 0 mT, to secure the area of 0 mT over 35° or greater, the half-value width of the developer layer thickness regulating pole S3 which is one of the repulsive magnetic poles must be made small, and there will arise the problem that the coat of the developer on the development sleeve becomes unstable. Accordingly, a magnetic pattern like that in the present embodiment is particularly necessary when the diameter of the development sleeve is 25 mm or less.

In the present embodiment, as the magnet 23, use is made of one having a pattern in which the area wherein the lower limit value Ga of the intensity Br of the magnetic field between the repulsive magnetic poles S3 and S1 is of the same polarity as the repulsive magnetic poles and the absolute value thereof is 4.6 mT or greater and 10 mT or less is 40° and the interval between the peak position of the intensity of the magnetic field of the developer layer thickness regulating pole S3 and the peak position of the intensity of the magnetic field of the stripping pole S1 is 105° and the position of the lower limit value Ga lies adjacent to the regulating pole S3 by 45° from the central position (104.5°) between the peaks of the magnetic poles S3 and S1.

In the present embodiment, by adopting the above-described magnetic pattern, no uneven screw pitch occurred to the developed image.

As previously described, in the present embodiment, the rotation of the photosensitive drum 3 and the rotation of the development sleeve 21 assume counter directions in the developing portion. If as shown in FIG. 2, the thickness of the developer layer on the development sleeve 21 is regulated in the lower portion of the developing device with respect to the direction of gravity, it will be easier to realize a construction in which the degree of compression of the developer is made small as in the present embodiment (because the developer not attracted to the development sleeve 21 exists in the lower portion of the developing container 27 with respect to the direction of gravity), and when the transferring portion is located on the lower portion of the photosensitive drum 3, the realization of a developing device having the construction of the present invention will become easy if the development sleeve 21 and the photosensitive drum 3 are rotated in counter directions.

As described above, according to the present embodiment, in an image forming apparatus wherein one of adjacent magnetic poles of the same polarity constituting the repulsive magnetic poles of a magnet in the developer bearing member of a developing device is used as a developer layer thickness regulating pole for regulating the layer thickness of a developer on the developer bearing member, and the developer bearing member and an image bearing member are rotated in counter directions to thereby effect magnetic brush development, the area in which the lower limit value Ga of the intensity Br of the magnetic field between the repulsive magnetic poles on the surface of the developer bearing member in a direction perpendicular to the surface is of the same polarity as the repulsive magnetic poles and is 10 mT or less in the absolute value of the intensity Br of the magnetic field is distributed over a width of 35° or greater in the circumferential direction of the developer bearing member, and design is made such that the lower limit value Ga is 2 mT or greater and 10 mT or less in absolute value and the lower limit value Ga is located toward the developer layer thickness regulating pole and therefore, the longer life of the developer and the downsizing of the developing device can be achieved, and the uneven density in the form of screw pitch of the black solid portion can be prevented to thereby obtain a uniform image free of unevenness.

The measurement of the intensity Br of the abovementioned magnetic field can be carried out by a method shown below.

The magnetic flux density Br in a normal direction at any position on the surface of the development sleeve (nonmagnetic cylinder) is measured by the use of the Gauss Meter Model 640 of Bell Inc.

During the measurement, the development sleeve 21 is horizontally fixed and the magnet 23 (magnetic field generating means) in the development sleeve is rotatably mounted. An axial probe is horizontally fixed while keeping a very minute interval (set to about 100 $\mu$m during the present measurement) with respect to the development sleeve 21 and so that the center of the development sleeve 21 and the center of this probe may be substantially on the same horizontal plane, and is connected to the gauss meter and measures the magnetic flux density on the surface of the development sleeve 21. The development sleeve 21 and the magnet 23 are substantially concentric circular structures, and the interval between the development sleeve 21 and the magnet 23 may be considered to be equal everywhere. Accordingly, by the magnet 23 being rotated, the magnetic flux density Br in the normal direction on the development sleeve 21 can be measured for every circumferential direction.

COMPARATIVE EXAMPLE 1

In Embodiment 1, as the magnet 23 in the development sleeve 21, use was made of a magnet having a pattern in which the area wherein the lower limit value Ga of the intensity Br of the magnetic field between the repulsive magnetic poles S3 and S1 on the surface of the development sleeve in the direction perpendicular to that surface is of the same polarity as the repulsive magnetic poles and the absolute value thereof is 4.5 mT within the range of the present invention, but the absolute value of the intensity Br of the magnetic field is 10 mT or less is a distribution of 32° in the circumferential direction of the development sleeve. The interval between the peak positions of the developer layer thickness regulating magnetic pole S3 and the stripping pole S1 was 105° as in Embodiment 1, and the position of the lower limit value Ga was adjacent to the regulating pole S3 by 45°.

This example was used for development under the same conditions as in Embodiment 1 in the other points, and image formation was effected to output black solid images of A3 size with a result that from the initial stage of the image formation, uneven density in the form of screw pitch attributable to the T/D ratio occurred to the trailing ends of the images.

COMPARATIVE EXAMPLE 2

In Embodiment 1, as the magnet 23 in the development sleeve 21, use was made of a magnet having a pattern in which the area wherein the lower limit value Ga of the intensity Br of the magnetic field between the repulsive magnetic poles S3 and S1 on the surface of the development sleeve in the direction perpendicular to that surface is of the same polarity as the repulsive magnetic poles and the absolute value thereof is 4.5 mT within the range of the present invention and the absolute value of the intensity Br of the magnetic field is 10 mT or less is a distribution of 42° in the circumferential direction of the development sleeve and the interval between the peak positions of the developer layer thickness regulating magnetic pole S3 and the stripping pole S1 is 105° as in Embodiment 1, but the position of the lower limit value Ga lies adjacent to the stripping pole S1 by 60°.

This example was used for development under the same conditions as in Embodiment 1 in the other points, and image formation was effected to output black solid images of A3 size with a result that from the initial stage of the image formation, uneven density in the form of screw pitch attributable to the M/S ratio occurred from the leading end of the image.

Embodiment 2

While in Embodiment 1, as the magnetic carrier in the two-component developer, use was made of a magnet in which the magnetization in a magnetic field of 100 mT is $25\times10^4$ A/m, this embodiment used a magnetic carrier in which the magnetization is weaker than that, i.e., $20\times10^4$ A/m or less, e.g. a magnetic carrier in which the magnetization is $15\times10^4$ A/m. In the other points, this embodiment was similar to Embodiment 1.

If in Embodiment 1, the magnetization of the magnetic carrier is weakened, the compression of the developer at the developer layer thickness regulating pole S3 of the repulsive magnetic poles of the magnet 23 will weaken and the life of the developer will be further lengthened. However, if the magnetization of the magnetic carrier is made excessively small, the magnetic carrier will become magnetically dull to the magnetic field and the developer on the development sleeve 21 after development will become liable to move to the developer layer thickness regulating pole S3 and therefore, it will become more difficult than in Embodiment 1 to strip the developer on the development sleeve 21 after development, and uneven density in the form of screw pitch will become liable to occur.

So, in the present embodiment, as the result of some studies, in the construction of Embodiment 1, i.e., an image forming apparatus wherein one of the adjacent magnetic poles of the same polarity constituting the repulsive magnetic poles of the magnet in the developer bearing member of the developing device is used as the developer layer thickness regulating pole for regulating the layer thickness of the developer on the developer bearing member and the developer bearing member and the image bearing member are rotated in the counter directions to thereby effect magnetic brush development, in addition to a construction in which an area wherein the lower limit value Ga of the intensity Br of the magnetic field between the repulsive magnetic poles on the surface of the developer bearing member in the direction perpendicular to that surface is of the same polarity as the repulsive magnetic poles and is 10 mT or less in the absolute value of the intensity Br of the magnetic field is distributed over a width of 35° or greater in the circumferential direction of the developer bearing member, and the lower limit value Ga is 2 mT or greater and 10 mT or less in absolute value and the lower limit value Ga is located toward the developer layer thickness regulating pole, the magnetization of the carrier is $20\times10^4$ A/m or less under a magnetic field of 100 mT.

The lower limit value of the magnetization of the carrier is $3.0\times10^4$ A/m. If the magnetization of the carrier is less than $3.0\times10^4$ A/m, there will occur a situation in which the developer does not coat the development sleeve.

Thus, the present embodiment can achieve the downsizing of the developing device and the longer life of the developer than in Embodiment 1, and also can prevent the uneven density in the form of screw pitch of the black solid portion and can obtain uniform images free of unevenness.

Embodiment 3

In Embodiment 1, the peak position of the developer layer thickness regulating pole S3 of the repulsive magnet poles of the magnet 23 is below the peak position of the stripping pole S1 with respect to the direction of gravity and the surface of the developer adjacent to the conveying screw 24 near the development sleeve 21 is located between the peak positions of the regulating pole S3 and the stripping pole S1.

In order to realize what has been described just above, Embodiment 1 was changed in the following points.

The first change is that the developer conveying speed was changed between the conveying screw 24 near the development sleeve 21 and the conveying screw 25 far from the development sleeve 21.

Specifically, the conveying screw 24 has a diameter of 14 mm and a pitch of 15 mm and has no rib, and the conveying screw 25 has a diameter of 14 mm and a pitch of 20 mm and has ribs. The ribs have a width of 4 mm and a height of 4 mm, and are mounted at locations of every other 180° between the vanes of the screw. The rotating speeds (the numbers of revolutions per unit time) of the conveying screws 24 and 25 were the same. Thereby, the developer conveying speed of the conveying screw 24 can be made lower than the developer conveying speed of the conveying screw 25.

The second change is that the amount of developer was increased by 10 g from 180 g in Embodiments 1 and 2 to 190 g. The T/D ratio of the developer is 8% (% by weight) as in Embodiments 1 and 2.

By making the above-described two changes, the surface of the developer adjacent to the conveying screw 24 can be set high while the state of the surface of the developer adjacent to the conveying screw 25 is kept the same as in Embodiments 1 and 2.

If the surface of the developer adjacent to the conveying screw 24 is disposed at a position between the peaks of the developer layer thickness regulating pole S3 and the stripping pole S1, it will become difficult for the developer on the development sleeve 21 after development to move to the regulating pole S3 side, and it will become more difficult than in Embodiment 1 for the uneven density in the form of screw pitch to occur.

In the present embodiment, specifically, the pattern of the magnet 23 is made such that an area wherein the lower limit value Ga of the intensity Br of the magnetic field between the magnetic poles S3 and S1 constituting the repulsive magnetic poles on the surface of the developer bearing member in the direction perpendicular to that surface is of the same polarity as the repulsive magnetic poles and is 10 mT or less in the absolute value of the intensity Br of the magnetic field is distributed over a with of 42° in the circumferential direction of the developer bearing member, and the lower limit value Ga is 4.5 mT in absolute value and the space between the peak positions of the magnetic poles S3 and S1 is 105° and the lower limit value Ga is located toward the regulating pole S3 by 50°.

As described above, in the present embodiment, in addition to the construction of Embodiment 1, the peak position of the developer layer thickness regulating pole is disposed below the peak position of the stripping pole with respect to the direction of gravity, and the surface of the developer adjacent to the developer conveying means near the developer bearing member is disposed between the peak position of the regulating pole and the peak position of the stripping pole and therefore, the longer life of the developer and the downsizing of the developing device can be achieved, and also the uneven density in the form of screw pitch of the black solid portion can be prevented and uniform images free of unevenness can be obtained.

As described above, according to the present invention, there can be provided a developing device and an image forming apparatus which can obtain good images in which uneven density in the form of screw pitch is suppressed by the development by a two-component developer and which enable the longer life of the developer and the downsizing of the device and apparatus to be achieved.

What is claimed is:

1. A developing device comprising:

a developing container for containing therein a developer provided with a carrier and a toner;

conveying means for conveying the developer in said developing container;

a developer bearing member for bearing thereon the developer conveyed by said conveying means, said developer bearing member conveying the developer to a developing portion for developing a latent image formed on an image bearing member;

magnetic field generating means provided in said developer bearing member for generating a magnetic field, said magnetic field generating means being provided with a first magnetic pole and a second magnetic pole, which form a repulsive magnetic field, wherein said second magnetic pole is disposed downstream of said first magnetic pole in a direction of rotation of said developer bearing member; and regulating means for regulating a layer thickness of the developer on said developer bearing member at a location substantially opposed to said second magnetic pole, wherein a minimum value position of the repulsive magnetic field is nearer to said second magnetic pole than to said first magnetic pole.

2. A developing device according to claim 1, wherein an absolute value of said minimum value is 2 mT or greater and 10 mT or less.

3. A developing device according to claim 2, wherein an area in which the absolute value of said minimum value is 10 mT or less is distributed over a width of 35° or greater in a circumferential direction of said developer bearing member.

4. A developing device according to any one of claims 1 to 3, wherein said conveying means includes a rotatable screw.

5. A developing device according to claim 4, wherein a distance between said developer bearing member and said conveying means at a most proximate portion thereof is 1 mm or greater and 7 mm or less.

6. A developing device according to claim 5, wherein the distance between said developer bearing member and said conveying means at the most proximate portion thereof is 2 mm or greater and 5 mm or less.

7. A developing device according to claim 6, wherein said second magnetic pole is provided below said first magnetic pole in a direction of gravity.

8. A developing device according to claim 7, wherein a surface of the developer in said developing container is set so as to lie between said first magnetic pole and said second magnetic pole in the direction of gravity.

9. A developing device according to claim 8, wherein a direction of movement of said image bearing member is counter to a direction of movement of said developer bearing member.

10. A developing device according to claim 1, wherein during development, a voltage including a superimposed DC voltage and an AC voltage is applied to said developer bearing member.

11. A developing device according to claim 1, wherein a diameter of said developer bearing member is 10 mm or greater and 25 mm or less.

12. A developing device according to claim 1, wherein a magnetization of said carrier is $3.0\times10^4$ A/m or greater and $20\times10^4$ A/m or less in a magnetic field of 100 mT.

* * * * *

UNITED STATES PATENT AND TRADEMARK OFFICE

CERTIFICATE OF CORRECTION

PATENT NO. : 6,704,534 B2
DATED : March 9, 2004
INVENTOR(S) : Masaru Hibino

It is certified that error appears in the above-identified patent and that said Letters Patent is hereby corrected as shown below:

Column 7,
Line 2, "53" should read -- S3 --.

Signed and Sealed this

Sixth Day of July, 2004

JON W. DUDAS
*Acting Director of the United States Patent and Trademark Office*